United States Patent [19]

Besson et al.

[11] Patent Number: 4,535,599

[45] Date of Patent: Aug. 20, 1985

[54] CONTROL DEVICE FOR REFRIGERATING EQUIPMENT

[75] Inventors: Duilio Besson; Claudio De Marco; Roberto Peruzzo, all of Pordenone; Giuseppe Ardit, Venice, all of Italy

[73] Assignee: Industrie Zanussi S.p.A., Pordenone, Italy

[21] Appl. No.: 442,777

[22] Filed: Nov. 18, 1982

[30] Foreign Application Priority Data

Feb. 5, 1982 [IT] Italy ..... 45704 A/82

[51] Int. Cl.[3] ..... F25D 21/06

[52] U.S. Cl. ..... 62/154; 62/156

[58] Field of Search ..... 62/154, 156, 176.2, 62/157, 158, 231, 234, 155

[56] References Cited

U.S. PATENT DOCUMENTS

| | | | |
|---|---|---|---|
| 3,912,913 | 10/1975 | Bunting | 235/150.1 |
| 4,129,993 | 12/1978 | Schotten | 62/156 |
| 4,142,375 | 3/1979 | Abe et al. | 62/158 |
| 4,169,358 | 10/1979 | Hansen et al. | 62/154 |
| 4,327,556 | 5/1982 | Zampini et al. | 62/153 |
| 4,327,557 | 5/1982 | Clarke et al. | 62/153 |
| 4,433,555 | 2/1984 | Thorsen | 62/154 |

FOREIGN PATENT DOCUMENTS

| | | |
|---|---|---|
| 1294855 | 4/1962 | France . |
| 1520473 | 3/1968 | France . |

*Primary Examiner*—Harry Tanner

*Attorney, Agent, or Firm*—Wenderoth, Lind & Ponack

[57] ABSTRACT

A control device for refrigerating equipment endowed with devices to regulate the temperature and the level of humidity in the refrigerated space utilizing temperature sensors located in the refrigerated space and/or in an evaporator and having at least one compressor.

The control device includes the basic control components for starting and stopping the compressor depending upon the temperature selected by manual control devices and upon the temperature measured by the above-mentioned sensors. It also includes a secondary control unit which is able to start and stop the defrosting of the evaporator depending upon the level of humidity selected by the above-mentioned manual control devices and obtained after a predetermined number of work cycles by the compressor. The control device in accordance with the present invention allows the optimization of the conditions of food conservation in refrigeration equipment, and further enables an increased efficiency and lowered energy consumption of the equipment.

5 Claims, 5 Drawing Figures

CONTROL DEVICE FOR REFRIGERATING EQUIPMENT

BACKGROUND OF THE INVENTION

The present invention is related to a control device for refrigerating equipment which is capable of automatically regulating the optimal operating conditions of the equipment.

To maintain the temperature of a refrigerated space and its low-temperature compartments within present limits, suitable thermostatic control devices are normally employed. These are primarily temperature sensors placed in contact with the evaporator or inside the refrigerated space and/or in the low-temperature compartments, and the regulator units associated with the sensors which are connected to the electrical circuitry of the refrigerating equipment's motor-driven compressor so as to be able to start and stop the motor-driven compressor depending upon the temperature reading of the sensors.

To eliminate the frost which accumulates during the operation of the evaporator following the condensation of the moisture present in the refrigerated space, the refrigerating equipment undergoes periodic defrosting cycles. These cycles are induced by stopping the compressor for periods of time which are sufficient to elevate the temperature in the evaporator, or through the use of a suitable heating element placed in contact with the external surface of the evaporator and connected to its electrical circuitry.

For this purpose, the thermostatic control device can be implemented so that the motor-driven compressor is stopped when the defrosting begins and the above-mentioned heating element is activated if so desired, and the operation is then reversed upon completion of the defrosting.

The thermostatic control devices currently in use are of the electrical or electro-mechanical type and are able to time, perhaps in combination with a more common timing device, semi-automatic or automatic defrosting cycles in the refrigerating equipment.

With a semi-automatic control device, the temperature of the refrigerated space can be varied within a manually predetermined range by manually presetting the control device in different regulative positions.

The defrosting cycle is then initiated by means of the manual operation of a specific momentary electrical switch which is associated with the control device and which is connected into the compressor's electric circuit, and is terminated automatically once the evaporator-determined temperature has been reached. In this circumstance, each defrosting cycle occurs after a relatively long period of time with respect to the previous defrosting cycle and can be initiated intermittently when the user so desires.

Moreover, during this cycle, the compressor is interlocked with the thermostatic control device and thereby maintains the refrigerated space at the selected temperature.

As a result, the air in the refrigerated space is constantly dehumidified, since the moisture is condensed on the surface of the evaporator which is constantly at below freezing temperatures even when the compressor is at rest. Therefore, this air has a notably reduced level of humidity, thus allowing the food to reach a higher level of dehydration.

With an automatic control device, regulation of the temperature in the refrigerated space is carried out in the above-described manner, while the defrosting cycle occurs differently.

In fact, every control device of this type is implemented in such a way as to automatically initiate the defrosting cycle after every start and stop operation of the compressor and to terminate the cycle upon reaching a predetermined temperature.

Thus, in comparison with the semi-automatic device, several defrosting cycles are carried out during the same amount of time. Consequently, the air in the refrigerated space is dehumidified less because the surface temperature of the evaporator is greater than 0 degrees C during each of the compressor's shut-off periods, thus causing the moisture which had condensed on the evaporator to return in part to the surrounding air.

This air then reaches a high level of humidity, thus lowering the level of dehydration in the food. However, the control devices in question, though allowing sufficient regulation of the temperature in the refrigerated space, don't allow the satisfactory indirect regulation of humidity in the same space to within determined limits as would be desired to assure optimal food-storage conditions in the refrigerated space.

SUMMARY OF THE INVENTION

The present invention is intended to overcome the inconveniences and the limitations of the above-described control devices by assuring the optimal operational conditions of refrigerating equipment as they relate to the temperature and humidity level of the refrigerated space.

In essence, the present invention is based on the use of more suitable devices for regulating the temperature and humidity in the refrigerated space. These devices are manually selectable and act on the compressor and, if necessary, on the heating elements used for defrosting so as to adequately control both the number of starts and stops of the compressor and the defrosting of the evaporator so as to reach the preset temperature and to vary the level of humidity in the refrigerated space. In this way, the refrigerating equipment is made to function under conditions intermediate to those obtainable through use of the above-described automatic and semi-automatic control devices through the use of a control device which is able to link the functional characteristics of both.

These and other purposes are achieved through use of this control device and refrigeration equipment which has at least a compressor and a defrostable evaporator in the refrigerated space. This control device is made up of manual or sensor operated components to regulate the temperature of the refrigerated space. These components are also able to read the temperature of the refrigerated space and/or of the evaporator. The control device is characterized by its basic control components which act to govern the compressor according to the temperature which has been selected by means of the above-described manual or sensory components, and by its humidity control components which determine the variable levels of humidity inside the refrigerated space. It is also characterized by secondary control components which initiate and terminate the defrosting cycles of the evaporator depending upon the level of humidity in the refrigerated space as selected by the above-said regulative components, and obtained after a predetermined number of compressor cycles.

BRIEF DESCRIPTION OF THE DRAWINGS

The characteristics and the advantages of this invention will become evident with the following illustrative, non-limiting description which refers to attached FIGS. 1, 2, 3 and 4 which show a control device in accordance with the present invention implemented in four different ways, and to FIG. 5 which is a functional diagram of a work cycle effected in accordance with the present invention.

DESCRIPTION OF THE PREFERRED EMBODIMENTS

Figure 2:
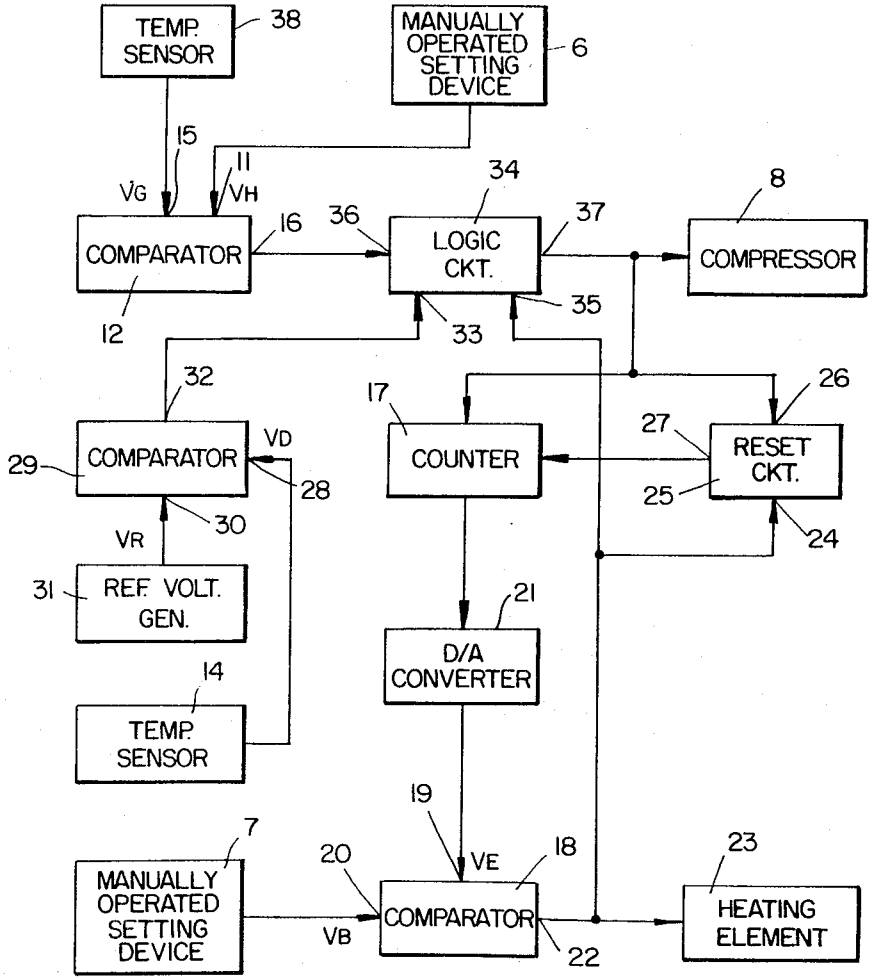

In order to achieve optimal conditions in the refrigerated space of refrigerating equipment, particularly refrigerators (whose average temperature must be maintained within predetermined limits in order to briefly conserve foods therein in good condition and so as to not lose their natural flavor), it is also necessary to be able to adequately regulate, within the level of humidity of the refrigerated space itself.

This control device acts to regulate both the temperature and the variable level of humidity in the refrigerated space.

The regulation is achieved through use of a electronic control device which is represented schematically by a series of functional blocks.

In reference FIG. 1, the setting device is essentially composed of two manually operated control devices, 6 and 7, which are placed in the refrigerated space of the refrigerating equipment in order to obtain a predetermined temperature and a variable level of humidity by a sequence of operations which will be described later. It is also made up of at least one conventional compressor 8, electrically startable and stoppable by ordinary means. Setting devices 6 and 7 each consist of a continuously adjustable potentiometer or other similar device, linked to a graduated manually-operated knob placed in a predetermined control position.

In this way, by placing the knob of each potentiometer in its relative control position, corresponding output voltages $V_A$ and $V_B$ of proportional size are obtained. The output voltage $V_A$ is then applied to input 9 of a conventional controlled voltage generator 10, which then furnishes an output voltage $V_C$ to input 11 of a first comparator 12, this condition occurring when no voltage is applied to the other input 13 of generator 10.

This control device also includes a conventional temperature sensor element 14, placed in contact with the external surface of the evaporator in the refrigerated space so as to register the temperature of the surface. This sensor generates an output voltage $V_D$ which corresponds to the temperature level measured on the evaporator surface and applies that output voltage to an input 15 of comparator 12.

Comparator 12 also has an output 16 connected to compressor 8 and to a conventional counter 17 which is able to progressively count and store the number of cycles carried out by the compressor.

In this way, the above-described $V_C$ and $V_D$ voltages are compared with each other in comparator 12 which, depending on the outcome of the comparison, operates compressor 8 and counter 17 by the following sequence of operations.

In addition, this control device includes a second comparator 18, which has two inputs, 19 and 20, which are connected respectively to counter 17 through a digital to analog converter 21 and to the manually operated setting device 7. This comparator also has an output 22 connected to the controlled voltage generator 10. Where the defrosting of the evaporator is carried out by at least one suitable heating element 23 of a conventional type in combination with said evaporator, output 22 is also connected to that element.

In this way, the output voltage $V_B$ produced by the manually operated setting device 7, depending on the control position of the relevant knob, and corresponding to both the number of on-off work cycles to be performed by the compressor 8 between evaporator defrost operations and also the humidity level to be obtained into the refrigerated space of the refrigeration equipment, is applied to the input 20 of the comparator 18 in order to be compared therein with the output voltage $V_E$.

This latter is produced by the digital-to-analog converter 21 depending on the number of on-off work-cycles performed by the compressor 8 between evaporator defrost operations and counted by the counter 17, said voltage $V_E$ being then applied to the input 19 of the comparator 18.

Furthermore, output 22 of comparator 18 is connected to the first input 24 of a conventional logic reset circuit 25, which has a second input 26 connected to output 16 of the first comparator 12. Said logic reset circuit 25 also has an output 27 connected to counter 17.

The purpose of logic reset circuit 25 is to reset counter 17 by the sequence of operations which will be described below so as to prepare it to continue counting the number of cycles performed by compressor 8.

The above noted control device functions as follows: after the food has been placed into the appropriate space in the refrigerating equipment, manually operated setting devices 6 and 7 are placed in their respective control positions, which are intended to directly produce predetermined temperature and indirectly produce a level of humidity close to that set in advance. Consequently, the aforementioned $V_C$ and $V_B$ voltages are respectively applied to input 11 of the first comparator 12 and to input 20 of the second comparator 18.

Setting device 6 and sensor 14 are arranged so that the corresponding $V_C$ and $V_D$ output voltage have the same order of magnitude so that they can subsequently undergo comparison in comparator 12.

More particularly, because the control position of setting device 6 is fixed, the corresponding $V_C$ output voltage remains at a constant level. On the other hand, because sensor 14 detects the continually variable evaporator surface temperature, the level of the corresponding $V_D$ output voltage is variable. Therefore, comparator 12 continually compares the level of the $V_C$ and $V_D$ output voltages, so as to verify a $V_C > V_D$ condition, with its output 16 assuming a first logic state which causes the engagement of compressor 8.

Consequently, the temperature of the evaporator and therefore the temperature of the refrigerated space gradually decreases until, upon reaching the temperature which was preset on the setting device 6, the $V_C$ and $V_D$ voltages become equal. At that point, output 16 of the comparator 12 assumes a second logic state which causes the stopping of the compressor 8 and sends an impulse to the counter 17 which then counts and stores the cycle executed by the compressor.

It is this succession of engaging and disengaging the compressor 8, controlled by the comparator 12, which maintains the temperature of the refrigerated space within the upper and lower preset limits.

Meanwhile, the counter 17 progressively monitors the number of compressor 8 cycles, storing and outputting the respective count results as corresponding logic output states which are expressed in digital form.

The counter 17 output is connected to the digital-to-analog converter 21, which transforms logic signal generated by the counter 17 into corresonding analog signals which are represented, for example, in the form of an output voltage $V_E$ which is subsequently applied to input 19 of the second comparator 18.

In this case, the setting device 7 as well as the counter 17 and the D/A converter 21 are arranged so that the specified output voltages, $V_B$ and $V_E$, are of the same order of magnitude so that they can subsequently undergo comparison in the comparator 18.

Because the control position of the setting device 7 is fixed, the corresponding output voltage $V_B$ remains at a constant level. On the other hand, because the counter 17 detects a continually variable number of compressor 8 work cycles, the corresponding output voltage $V_E$ is of a variable level.

Thus, the comparator 18 continually compares the voltage levels of output $V_B$ and $V_E$ and, as long as $V_B$ is greater than $V_E$, its output 22 assumes a first logic state which maintains the heating element 23 in its off state and the controlled voltage generator 10 in an unchanged condition.

In this case, the compressor 8 has not yet performed the number of work cycles determined by the control position of the setting means 7 and hence, the refrigerated space has not yet achieved the required level of humidity, so that the compressor 8 is still controlled by the comparator 12 by the sequence of operations described above and the counter 17 continues to count the work cycles of the compressor.

Nevertheless, as soon as voltage $V_B$ becomes equal to voltage $V_E$ so that the humidity of the refrigerated space is near the required level as caused by the operation of the compressor 8 for a number of work cycles which have been predetermined by the position of setting device 7, output 22 of the comparator 18 assumes a second logic state. The compressor 8 is then stopped and the defrosting of the evaporator begins. The heating element 23 would be operated at this point. Then, input 24 of logic circuit 25 assumes the same logic state as that of output 22. The logic circuit 25 is programmed to reset the counter 17. This cannot be immediately accomplished, however, since the other input 26 of said logic circuit is in a different logic state.

At the same time, voltage $V_B$ is being applied to input 13 of the controlled voltage generator 10, which then produces a corresponding output voltage $V_F$ which is applied to input 11 of the comparator 12 in exchange for the previous output voltage $V_C$.

In this condition, a gradual temperature increase occurs in the evaporator and sensor 14 generates an output voltage $V'_D$ which is different from the previous one, which is then applied to input 15 of the comparator 12.

In turn, the comparator 12 is programmed to determine a new condition of equilibrium between the output voltages $V_F$ and $V'_D$ when the sensor 14 detects an evaporator temperature of more than 5° C., for example, or in other words when the evaporator has been adequately defrosted.

Moreover, until $V_F$ becomes greater then $V'_D$, output 16 of the comparator 12 assumes a first logic state which stops the compressor 8 and keeps it that way.

That means that the compressor 8 is stopped as soon as the defrosting begins and a different equilibrium is determined for the comparator 12 with the operating sequence specified above. The temperature of the evaporator then increases progressively and as soon as $V_F = V'_D$, output 16 of the comparator 12 assumes a second logic state which starts the compressor 8 and thus terminates the defrosting of the evaporator.

At the same time, input 26 of the logic circuit 25 assumes the same logic state as output 16. Thus, both inputs of the logic circuit 25 are in the logic state necessary to reset the counter 17. This causes a different output voltage $V_E$ to be applied to the comparator 18, so that output 22 again assumes its first logic state and consequently the heating element 23 is turned off.

At the same time, the reference voltage $V_R$, which is applied to input 13 of the controlled voltage generator 10 is removed.

The respective output voltages, $V_C$ and $V_D$, are then applied to inputs 11 and 15 of the comparator 12, and the control device is programmed to carry out a new functional cycle according to the operating sequence already described above.

FIG. 2 is a block diagram of the control device implemented in a second way.

Figure 1:
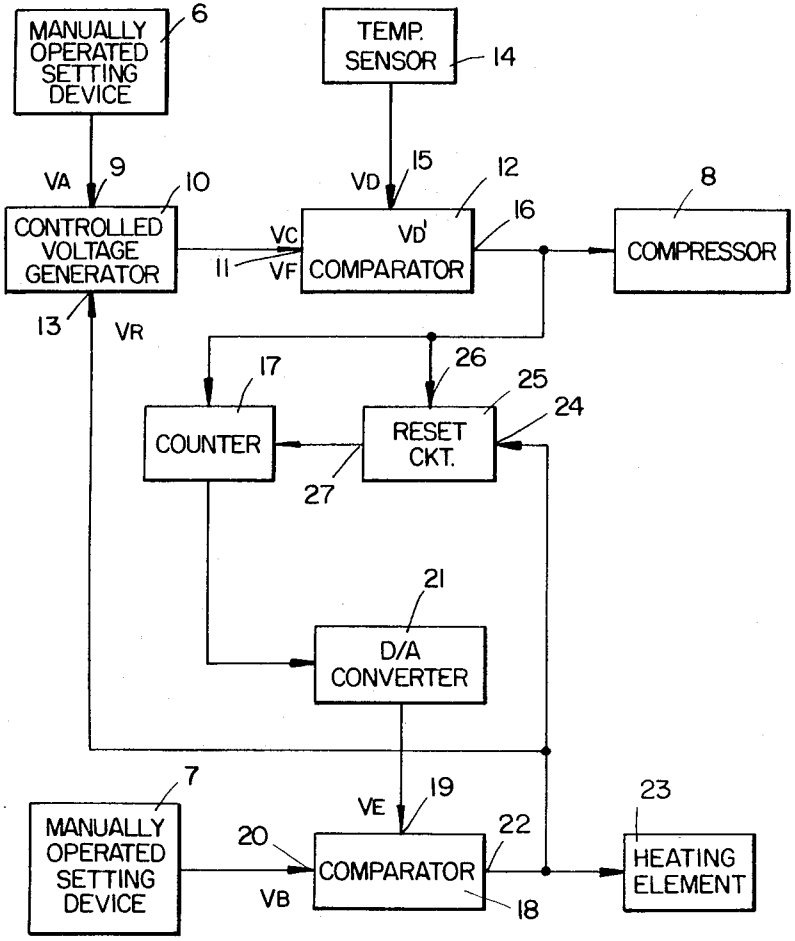

This control device is analagous to the one in FIG. 1 and is fabricated essentially of the same circuit components. Therefore, such corresponding components are referred to by the same numerical designation in both drawing figures.

In FIG. 2, the evaporator temperature sensor 14 is no longer connected to the comparator 12 as in FIG. 1, but is connected instead to input 28 of still another comparator 29, which has a second input 30 which is connected to a reference voltage generator 31 and input 32 connected to the first input 33 of a conventional logic circuit 34. Logic circuit 34 has two more inputs 35 and 36 which are respectively connected to ouput 22 of comparator 18 and to output 16 of the comparator 12. In addition, logic circuit 34 has an output 37 connected to the counter 17 and the compressor 8.

The control device of FIG. 2 also has a second conventional temperature sensor 38, placed in the space of the equipment used to regulate the temperature. The sensor 38 generates a corresponding output voltage $V_G$ which is applied to input 15 of the comparator 12. In this way, the setting device 6 is programmed to control the temperature of the space and to generate a corresponding output voltage $V_H$ which is applied to the other input 11 of comparator 12.

In turn, the sensor 14 generates an output voltage $V_D$, corresponding to the temperature detected on the evaporator, which is applied to input 28 of the comparator 29, which continually compares it to the fixed reference voltage $V_R$ from generator 31, a voltage which corresponds to a temperature of over 5° C., for example, on the evaporator and therefore to the final defrosting condition of the evaporator itself.

Then, depending on the comparison by comparator 12 between output voltages $V_G$ and $V_H$, circuit 34 governs the compressor 8 and the counter 17 with the same previously described operating sequence, in accordance with the conditions of allowability at inputs 33 and 35.

The inputs 33 and 35 are initially in a certain logic state which allows the logic circuit 34 to control the operation of the compressor 8 and the counter 17.

Consequently, when the refrigerated space reaches a required level of humidity, the compressor 8 is stopped and the defrosting is begun, with the possible operation of the heating element 23 in the same way described above.

In addition, the logic state of both inputs 24 and 26 of reset logic circuit 25 and the inputs 33 and 35 of logic circuit 34 is varied so as to respectively perform the resetting of the counter 17 and the switching of logic circuit 34 to a different state in which it is no longer able to control the compressor 8 and the counter 17, but instead is operatively connected to and controlled by comparator 29.

In this way, comparator 29 is programmed to compare the output voltages $V_D$ and $V_R$.

When $V_R$ is greater than $V_D$, output 32 of comparator 29 and therefore input 33 of logic circuit 34 assumes a first logic state, which is different from the logic state at the other input 35 of the logic circuit 34.

Consequently, logic circuit 34 remains in an unchanged condition.

Since the defrosting of the evaporator is ongoing, the evaporator temperature is progressively rising and so is the output voltage $V_D$ produced by sensor 14. As soon as $V_R$ is equal to $V_D$, output 32 of comparator 29 and input 33 of logic circuit 34 assume a second logic state, which is equal to the logic state of the other input 35 of the logic circuit 34.

Consequently, the logic circuit 34 is switched into the previous logic state, in which it is again able to control the compressor 8 and the counter 17. In the meantime, since the temperature has risen in the refrigerated space, sensor 38 detects that this temperature is greater than the one selected and produces an output voltage $V_G$ which is greater than the output voltage $V_H$ of potentiometer 6.

Under these conditions, the compressor 8 is again started by the steps outlined in FIG. 1, thus ending the defrosting cycle.

Output 22 of comparator 18 assumes another logic state, thus turning off the optional heating element 23 and programming the control device to carry out a new work cycle.

Figure 4:
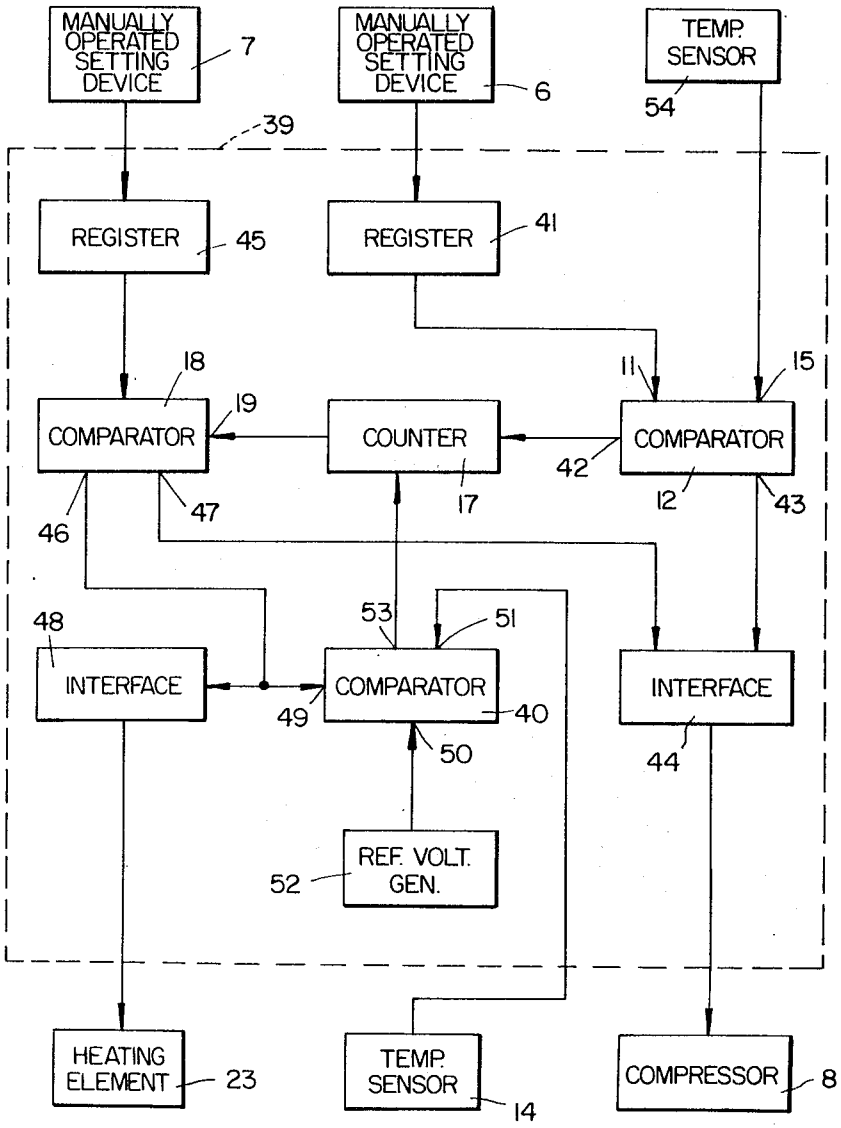
Figure 3:
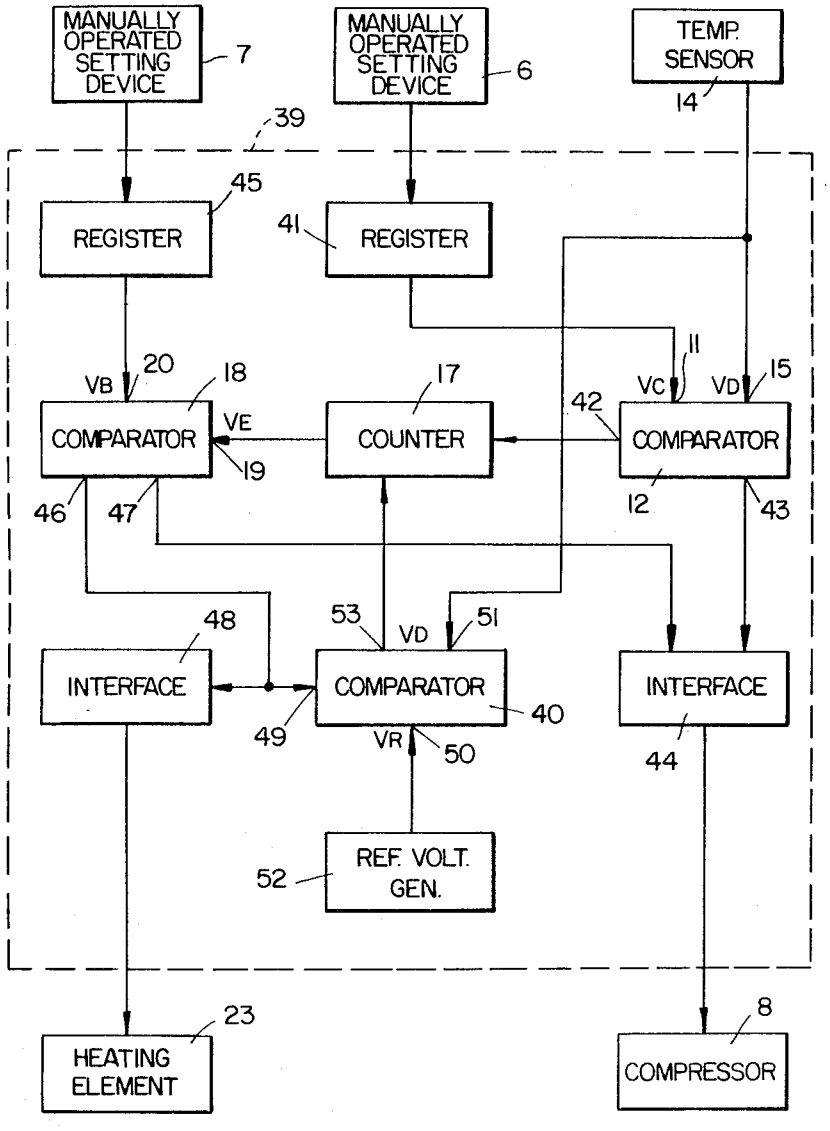

In FIGS. 3 and 4, the control device is schematically shown in two further modes of implementation in which a microprocessing electronic circuit is used.

In FIG. 3, the control device includes a microprocessor 39 connected to two pushbuttons 6 and 7, the compressor 8, the optional heating element 23 and the temperature-detecting sensor14 of the evaporator which was described previously. The microprocessor 39 includes comparators 12 and 18 and the above-described counter 17, as well as an additional comparator 40.

In this case, pushbutton 6 is connected to input 11 of comparator 12 through a conventional register 41 in which the different presettings selected through pushbutton 6 are progressively counted and stored. Comparator 12 also has a second input 15 connected to sensor 14 as before, plus two outputs, 42 and 43, connected respectively to input 19 of comparator 18 through the counter 17, and to the compressor 8 through a conventional interface 44.

Output 42 is activated when $V_D$ is greater than $V_C$ and output 43 is activated when $V_D$ is less than $V_C$.

In turn, the other input 20 of comparator 18 is connected to pushbutton 7 through a conventional register 45, in which the different presettings selected through pushbutton 7 are progressively counted and stored.

In addition, comparator 18 has two outputs, 46 and 47. Output 46 is connected to the optional heating element 23 through a conventional interface 48. Output 47 is connected to the compressor 8 througn said interface 44.

Output 46 is activated when $V_B$ is equal to $V_E$. Output 47 is activated when $V_B$ is greater than $V_E$.

Output 46 of comparator 18 is also connected to input 49 of comparator 40, which also has two inputs, 50 and 51. Input 50 is connected to a reference voltage generator 52. Input 51 is connected to input 15 of comparator 12, which also has an output 53 connected to counter 17.

In this way, the output voltage $V_R$ produced by the generator 52 of the same fixed value previously described, is applied to input 50, and the output voltage $V_D$ produced by the aforementioned sensor 14 is applied to input 51. Comparator 40 compares voltages $V_R$ and $V_D$ and, when the temperature of the evaporator as detected by sensor 14 exceeds 5° C., for example, the comparator 40 output 53 then resets counter 17.

This control device thus operates in the same fashion as the device shown in FIG. 1.

In this case then, until $V_D$ is less than $V_C$, output 42 of comparator 12 remains activated and the compressor 8 continues to operate, producing a gradual decrease in the evaporator temperature.

Nevertheless, as soon as $V_D$ is equal to $V_C$, output 42 is deactivated and output 43 of comparator 12 is activated, causing the compressor 8 to cease functioning through the operation of interface 44. Consequently, the counter 17 detects the succession of work cycles carried out by the compressor 8.

Therefore, until $V_B$ is greater than $V_E$, output 47 of comparator 18 is activated, which allows the compressor 8 to be operated.

Nevertheless, as soon as $V_B$ and $V_E$ are equal, ouput 47 is deactivated and output 46 of comparator 18 is activated.

As a result, the defrosting of the evaporator begins and, if so designed, the heating element 23 is operated through interface 48. Meanwhile, the compressor 8 remains off during the entire defrosting period. Likewise, input 49 of comparator 40 assumes the same level as output 46 of comparator 18, enabling comparator 40 to activate output 53. This condition will not be arrived at until the evaporator temperature is less than 5° C., for example.

Nevertheless, as soon as the temperature is higher than 5° C., for example, said output 53 is activated, which causes the counter 17 to be reset.

The optional heating element 23 is also shut off and the compressor 8 started through interface 44, thus ending the defrosting of the evaporator and another work cycle is begun.

In FIG. 4, the control device includes a microprocessor 39 connected to the same components as in FIG. 3, but with an additional sensor 54 placed in the refrigerated space to detect the temperature therein.

The microprocessor 39 of FIG. 4 includes the same components as the one in FIG. 3; however, in FIG. 4, input 15 of comparator 12 is connected to sensor 54, while input 51 of comparator 40 is connected to sensor 14.

The control device of FIG. 4 operates in the same way as the device in FIG. 3.

Figure 5:
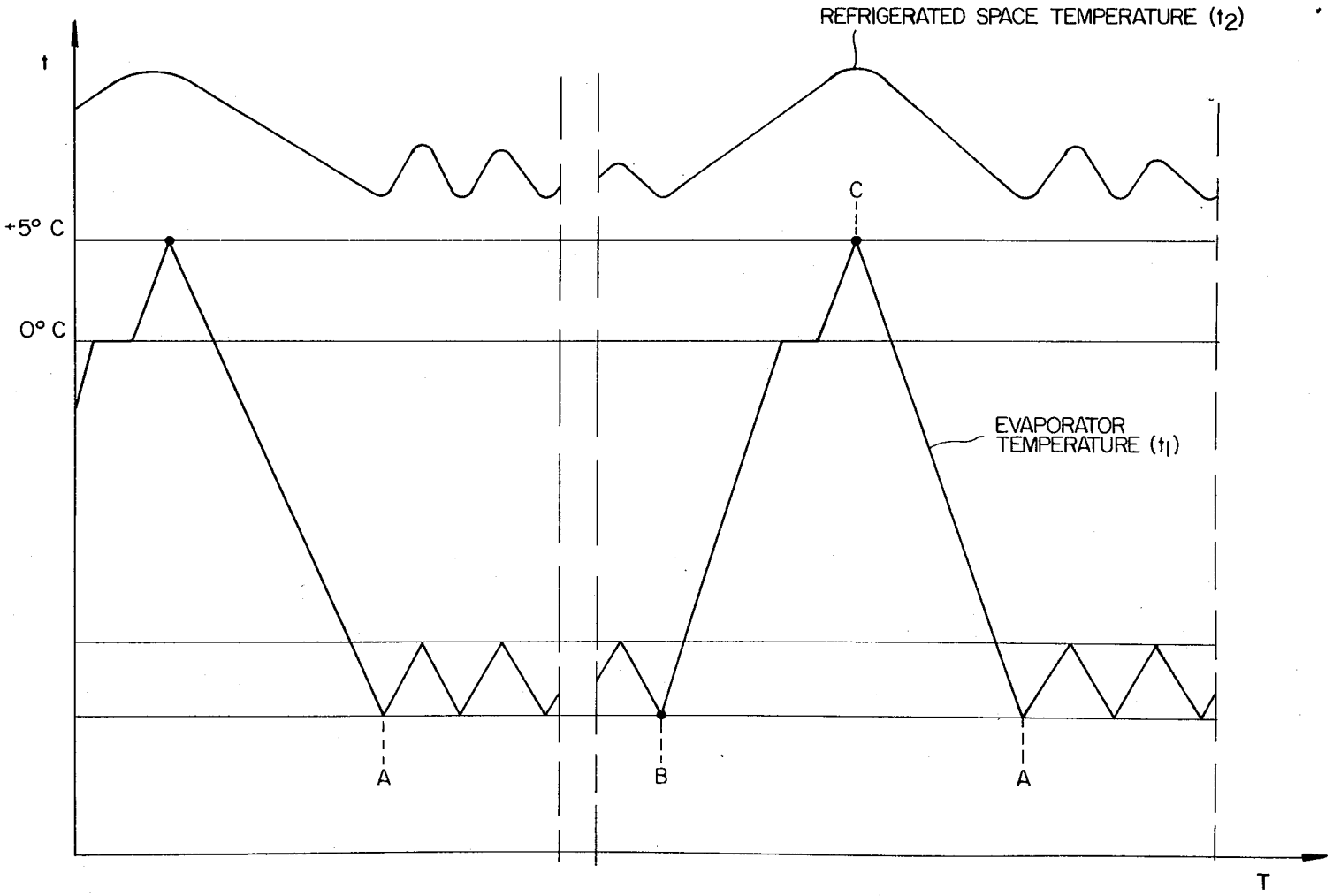

In FIG. 5 a diagram of the work cycle of the control device is shown. In the diagram, note that the temperature variations of the refrigerated space are represented in connection with the work times T of the compressor.

During the period in which the compressor is started and stopped through the sequence of operations described above (a period defined by positions A and B), the temperature of the evaporator stays above 0° C., varying within present maximum and minimum limits. Consequently, the average temperature of the refrigerated space also reaches a predetermined level.

As soon as the compressor has completed the number of selected preset cycles, corresponding to the required level of humidity (position B), the compressor is stopped and the defrosting of the evaporator is begun according to the operating sequence described above, causing a gradual rise in the evaporator temperature.

Then, once the evaporator reaches a temperature of 5° C. corresponding to the completed defrosting cycle (position C), the compressor is again started.

Subsequently, the work cycle continues according to the same operating sequence.

It is evident, then, that this control device permits optimal conditions in refrigerating equipment both through the direct regulation of the temperature in the refrigerated space and by controlling the number of work cycles of the compressor, indirect regulation of the level of humidity to be maintained in the refrigerated space.

This means that foods can be satisfactorily conserved without deteriorating or losing their natural flavor. Likewise, the control device permits dependable control over the compressor, allowing working conditions which are a compromise between those obtainable through previously used automatic or semi-automatic control devices.

Naturally, the device can be implemented in different ways, by using electro-mechanical devices such as timers, for example, which can possibly be combined with electronic devices of the type already specified.

We claim:

1. A control device for refrigerating equipment having at least one compressor and one defrostable evaporator placed in a space to be refrigerated, said device comprising: first and second manual setting means for generating respective output voltage corresponding to the temperature to be selected for said space and to the number of work cycles corresponding to the humidity level to be obtained in said space, said second manual setting means controlling the number of on-off work cycles to be performed by said means compressor between defrost operations; first and second sensor means for respectively detecting the temperatures of said space and of said evaporator and for generating corresponding output voltages, which respectively control the on-off work cycles of the said compressor according to the space temperature and to the evaporator temperature; a first electronic control means for controlling the on-off work cycles of said compressor depending on the output voltages generated respectively by said first manual setting means, according to the temperature to be obtained in said space and by said first sensor means, according to the temperature detected in said space; a second electronic control means for controlling the on-off work cycles of said compressor between defrost operations, depending on the output voltages generated by said second manual setting means, according to the selected number of on-off work cycles to be performed by said compressor and by a counter means which counts the number of on-off work cycles performed by said compressor, said second electronic control means stopping said compressor when the number of on-off work cycles counted by said counter means is equal to the number selected by said second manual setting means; a heating means for heating said evaporator and defrosting it, said heating means being controlled by said second electronic control means so as to be switched off when said compressor is operating and switched on when said compressor is stopped; and a third electronic control means for controlling the re-start of said compressor depending on the output voltages which are respectively generated by said second sensor means and by at least one reference voltage generator having a fixed reference voltage corresponding to the end of the evaporator defrosting, said third electronic control means determining the re-start of said compressor when said evaporator has been heated by said heating means at a temperature corresponding to the end of its defrosting.

2. A control device according to claim 1, wherein said first electronic control means comprises a comparator and a logic circuit, said comparator being provided with two inputs connected respectively to said first manual setting means and to said first sensor means and having one output connected to an input of said logic circuit; said logic circuit output being connected to said compressor and said counter means.

3. A control device according to claim 2, wherein said second electronic control means further comprises another comparator having two inputs respectively connected to said second manual setting means and to said counter means through at least one digital-to-analog converter means, and having an output connected to both said input of said logic circuit and to said heating means.

4. A control device according to claim 3, wherein said counter means is resettable by a logic reset means having two inputs respectively connected to both said output of said logic circuit and to said output of said another comparator and also having an output connected to a reset input of said counter means.

5. A control device according to claim 2, wherein said third electronic control means comprises a comparator having two inputs respectively connected to said second sensor means and to said reference voltage generator, and having an output connected to said input of said logic circuit.

* * * * *